US008042488B2

(12) United States Patent
Yamada

(10) Patent No.: US 8,042,488 B2
(45) Date of Patent: Oct. 25, 2011

(54) ELECTROSTATIC COATING APPARATUS

(75) Inventor: Yukio Yamada, Fujieda (JP)

(73) Assignee: ABB K.K., Tokyo (JP)

( * ) Notice: Subject to any disclaimer, the term of this patent is extended or adjusted under 35 U.S.C. 154(b) by 0 days.

(21) Appl. No.: 13/008,670

(22) Filed: Jan. 18, 2011

(65) Prior Publication Data

US 2011/0107966 A1 May 12, 2011

Related U.S. Application Data

(63) Continuation of application No. 11/571,276, filed as application No. PCT/JP2005/013524 on Jul. 15, 2005.

(30) Foreign Application Priority Data

Aug. 10, 2004 (JP) ..... 2004-233630

(51) Int. Cl.
*B05B 5/025* (2006.01)

(52) U.S. Cl. ..... 118/621; 239/690; 239/691; 118/629

(58) Field of Classification Search ..... 118/629, 118/621; 239/690, 691
See application file for complete search history.

(56) References Cited

U.S. PATENT DOCUMENTS

| | | | | |
|---|---|---|---|---|
| 3,875,892 | A * | 4/1975 | Gregg et al. | 118/665 |
| 4,672,500 | A | 6/1987 | Tholome et al. | |
| 5,208,078 | A * | 5/1993 | Ishibashi et al. | 427/483 |
| 5,582,875 | A | 12/1996 | Ryosuke | |
| 5,932,011 | A | 8/1999 | Noakes et al. | |
| 5,939,993 | A | 8/1999 | Burtin et al. | |
| 6,437,963 | B1 | 8/2002 | Hamilton et al. | |
| 6,790,285 | B2 | 9/2004 | Matsumoto | |
| 2003/0141391 | A1 | 7/2003 | Kawamoto et al. | |
| 2005/0040262 | A1 | 2/2005 | Nagai | |

FOREIGN PATENT DOCUMENTS

| | | | |
|---|---|---|---|
| JP | 04349956 | A * | 12/1992 |
| JP | 9-262510 | | 10/1997 |
| JP | 09262510 | A * | 10/1997 |
| JP | 2002143726 | A | 5/2002 |
| JP | 2002-186884 | | 7/2002 |
| JP | 2002186884 | A | 7/2002 |

OTHER PUBLICATIONS

Rajan et al, Linear Circuit Analysis, The Electrical Engineering Handbook, London; Elsevier Academic Press, 2005, pp. 6-8.

* cited by examiner

*Primary Examiner* — Dah-Wei Yuan
*Assistant Examiner* — Charles Capozzi
(74) *Attorney, Agent, or Firm* — Oblon, Spivak, McClelland, Maier & Neustadt, L.L.P.

(57) ABSTRACT

A current sensor for detecting a full return current is connected to a high voltage generator. A leakage current detector including current sensors for detecting a leakage current is provided at the surface of the cover of a coating machine, air passages and a paint passage. Based on current detection values obtained by the current sensors, a high voltage control unit controls a power supply voltage control unit and a high voltage to be output from the high voltage generator can be raised or dropped. By employing the current detection values, the high voltage control unit can identify and provide notification of a location where the leakage current is increased and the insulation is deteriorated, and can request an operator to perform maintenance for the pertinent location. Further, upon occurrence of the insulation being deteriorated, the high voltage control unit can stop the high voltage supply.

12 Claims, 8 Drawing Sheets

Fig.3

| | CUTOFF THRESHOLD CURRENT VALUE | ALARM THRESHOLD CURRENT VALUE |
|---|---|---|
| FULL RETURN CURRENT DETECTION VALUE It | It0=200μA | ——— |
| OBJECT CURRENT VALUE Ix | Ix0=80μA | ——— |
| CURRENT DETECTION VALUE Ia FOR EXTERNAL SURFACE OF COVER 2 | Ia0=60μA | Ia1=40μA |
| CURRENT DETECTION VALUE Ib FOR AIR PASSAGE 4 | Ib0=10μA | Ib1=6μA |
| CURRENT DETECTION VALUE Ic FOR AIR PASSAGE 7 | Ic0=10μA | Ic1=6μA |
| CURRENT DETECTION VALUE Id FOR AIR PASSAGE 12 | Id0=10μA | Id1=6μA |
| CURRENT DETECTION VALUE Ie FOR PAINT PASSAGE 9 | Ie0=15μA | Ie1=10μA |

ELECTROSTATIC COATING APPARATUS

CROSS REFERENCE TO RELATED APPLICATIONS

This application is a continuation application of U.S. application Ser. No. 11/571,276, filed Dec. 26, 2006, the contents of which is incorporated herein by reference, which is the National Stage of PCT/JP05/13524 filed Jul. 15, 2005, which claims priority under 35 U.S.C. §119 to Japanese Application No. 2004-233630 filed Aug. 10, 2004.

BACKGROUND OF THE INVENTION

1. Field of the Invention

This invention relates to an electrostatic coating apparatus that sprays paint while applying a high voltage to a coating machine.

2. Description of Related Art

Generally, there have been known so-called electrostatic coating apparatuses which are comprised of a coating machine employing a rotary atomizing head to spray paint toward a coating object, a high voltage generator boosting a power supply voltage for generating a high voltage and outputting the high voltage to the rotary atomizing head of the coating machine, a power supply voltage control unit controlling a power supply voltage to be supplied to the high voltage generator, and a high voltage control unit outputting a setting signal to the power supply voltage control unit to designate a power supply voltage and controlling a high voltage to be output by the high voltage generator (see, for example, Japanese Patent Laid-Open No. 2002-186884).

According to the electrostatic coating apparatus provided by the prior arts, the rotary atomizing head serves as an electrode for discharging a high voltage toward a coating object. Therefore, an electrostatic field is formed between the rotary atomizing head and the coating object being a ground potential. Moreover, paint particles charged at a high voltage through the rotary atomizing head are flied along the electrostatic field to the coating object and land thereon.

Further, in the electrostatic coating apparatus, the low voltage side of the high voltage generator is maintained as the ground potential. Therefore, for the electrostatic coating apparatus, an electrostatic field is formed not only between the rotary atomizing head and the coating object as described above, but also between the rear side of the electrostatic coating apparatus which is the ground side of the high voltage generator and the rotary atomizing head. At this time, suspended particles such as a sprayed mist and dust, water in the air and so forth are adsorbed and attached to the surface of the cover of the coating machine, and it effects to reduce the surface resistance of the cover and deteriorate the insulation of the electrostatic coating apparatus. Now, a high voltage application path is formed by the paths of the power supply, the high voltage generator, the rotary atomizing head, the coating object, and so forth. In the case of the electrostatic coating apparatus according to the above-mentioned prior art, a current (hereinafter called a full return current) that flows through the path of the high voltage generator contained in the high voltage application path is detected, and based on the amplitude of the detected current, deterioration of the insulation of the cover is detected.

In the case of the electrostatic coating apparatus by the above-mentioned prior art, deterioration of the insulation of the cover is detected based on the full return current that flows through the high voltage generator that forms part of the high voltage application path. However, in addition to a current (hereafter referred to as an object current) that flows between the rotary atomizing head and the coating object along the high voltage application path, there is also a current (hereinafter referred to as a leakage current) that flows along a leakage path other than the high voltage application path while also passing through the high voltage generator. Therefore, the full return current includes the object current that passes between the rotary atomizing head and the coating object, and the leakage current that flows along the surface of the coating machine. At this time, the leakage current of the coating machine occurs are not only the surface of the cover of the coating machine, but also the inner wall of the paint passage in the coating machine and the inner wall of the air passage for spray pattern formation, and so forth.

For example, even if the inner wall of the paint passage is appropriately cleansed, pigments contained in the paint tend to gradually accumulate as the operation is continued. Therefore, due to the residually accumulated pigments, the insulation resistance is reduced and a high voltage creepage discharge tends to occur. Especially when a so-called metallic paint containing a metal pigment such as aluminum powder is employed, the pigment served as a conductor accumulates on the inner wall of the paint passage, so that a reduction in the insulation resistance becomes noticeable.

Furthermore, when shaping air for spray pattern formation, pilot air for an air valve to control the supply of paint and the cutoff of the supply, and drive air for an air motor to drive the rotary atomizing head, are passed along the air passage, fine dust and water contained in the air are deposited to the inner wall of this passage and a high voltage creepage discharge tends to occur.

As described above, the coating machine is in a state wherein a leakage current could occur at plural positions. On the other hand, when a reduction of the insulation based on the full return current is detected, it is difficult to determine either the object current or the leakage current are increased, and furthermore, the location occurred the leakage current can not be identified.

Thus, the leakage current can not be sufficiently prevented by cleaning the surface of the cover of the coating machine and a cutoff of the high voltage frequently occurs due to an increase in an abnormal current value, so that stop times of the coating machine tends to be increased and the coating productivity is lowered. In addition, since the location occurred the leakage current can not be identified, a progress of a dielectric breakdown for the surface of the cover, the inner wall of the paint passage and the air passage are unknown, and damage (electric damage-by-fire) to the coating machine can not be prevented.

BRIEF SUMMARY OF THE INVENTION

In view of the above-discussed problems with the prior art, an object of the present invention is to provide an electrostatic coating apparatus that the location of an occurrence of a leakage current can be identified, and damage of a coating machine can be prevented in order to enhance reliability, durability and coating productivity.

(1) In order to solve the above-discussed problems, the present invention is applied for an electrostatic coating apparatus including a coating machine for spraying paint to a coating object, a high voltage generator for boosting a power supply voltage to generate a high voltage and for outputting the high voltage to the coating machine, a power supply voltage control unit for controlling a power supply voltage to be supplied to the high voltage generator, and a high voltage control unit for outputting a setting signal to set a power supply voltage for the power supply voltage control unit and for controlling a high voltage to be output by the high voltage generator.

The configuration adopted by the present invention is characterized by comprising full return current detection means for detecting a full return current that flows through the high voltage generator, and leakage current detection means for detecting flow of a leakage current that does not pass through the coating object; wherein the high voltage control unit including power supply cutoff means for outputting a cutoff signal to the power supply voltage control unit to cut off the supply of the power supply voltage when deterioration of insulation for the coating machine is determined by employing a full return current detection value obtained by the full return current detection means and a leakage current detection value obtained by the leakage current detection means, and alarm means for outputting an alarm that the reduction of insulation has occurred in the coating machine when reduction of insulation at the initial stage is determined by employing a leakage current detection value obtained by the leakage current detection means.

With the arrangements just described, as a result of a determination of the power supply cutoff means whether the full return current detection value obtained by the full return current detection means exceeds a predetermined cutoff threshold current value or whether the leakage current detection value obtained by the leakage current detection means exceeds a predetermined cutoff threshold current value, it is possible to determine whether the insulation of the coating machine has been deteriorated as much as a dielectric breakdown might occur. Therefore, by employing the full return current detection value, the power supply cutoff means is possible to determine the deterioration of the insulation which is because the coating machine has been moved abnormally near the object. Further, the leakage current detection value is employed to determine the occurrence of a reduction in the insulation at the locations (e.g., the surface of the cover of the coating machine, the inner wall of the paint passage, the inner wall of the air passage) of the leakage current passes.

Furthermore, the leakage current detection means for detecting the flow of a leakage current that does not pass through the coating object is provided. Thus, when the alarm means determines, for example, whether the leakage current detection value exceeds a predetermined alarm threshold current value that is smaller than the cutoff threshold current value, it is possible to determine whether a reduction in the insulation at the initial stage has occurred before the insulation for the coating machine has been deteriorated. Therefore, by using the leakage current detection value, the alarm means can obtain the progress of dielectric breakdown at locations (e.g., the surface of the cover of the coating machine, the inner wall of the paint passage, the inner wall of the air passage) other than the area between the coating object and the coating machine. As a result, before damage due to creepage discharge has progressed at these locations, a notification of a reduction in the insulation can be provided, for example, through the generation of an alarm, which serves to notify an operator that maintenance (inspection, cleaning, etc.) is required to prevent damage to the coating machine and to increase reliability and durability.

Especially, for example, when the leakage current detection means is employed to detect the leakage current separately at the surface of the cover of the coating machine, the inner wall of the paint passage and the inner wall of the air passage, the alarm means can identify a location whereat the leakage current has been increased among the locations whereat the leakage current has occurred. Thus, when the location whereat the leakage current has increased is notified by using the alarm means, the operator need only perform maintenance for the coating machine location identified by the alarm means, so that the time required for the maintenance of the coating machine can be shortened and the coating productivity can be increased.

(2) According to the arrangement of the present invention, the leakage current detection means includes an external surface current detector for detecting a current that flows along the external surface of the coating machine.

With this arrangement, the leakage current that flows along the external surface of the coating machine can be detected by employing the external surface current detector. As a result, since the power supply cutoff means and the alarm means can recognize the progress of a dielectric breakdown on the external surface of the coating machine, it can be determined that an adsorbed material has been accumulated on the external surface of the coating machine and that the insulation has been reduced and deteriorated. Therefore, since the power supply cutoff means can cut off the supply of a high voltage before a breakdown is occurred at the external surface of the coating machine, damage to the coating machine can be prevented and the reliability and durability can be increased. Further, before damage due to creepage discharge has progressed at the external surface of the coating machine, the alarm means can provide notification of a reduction in the insulation by generation of an alarm and request an operator to clean the external surface of the coating machine.

(3) According to the arrangement of the present invention, the leakage current detection means includes a paint passage current detector for detecting a current that flows along a paint passage within the coating machine.

With this arrangement, the leakage current flowing along the paint passage can be detected by using the paint passage current detector. As a result, since the power supply cutoff means and the alarm means can recognize the progress of a dielectric breakdown along the paint passage, it can also be determined that pigment has been determined to and accumulated on the inner wall of the paint passage, and the insulation has been reduced or deteriorated. Therefore, since the power supply cutoff means can cut off the supply of a high voltage before a dielectric breakdown occurs along the inner wall of the paint passage, damage to the paint passage can be prevented and the reliability and durability can be increased. Furthermore, before damage to the inner wall of the paint passage due to creepage discharge has progressed, the alarm means can generate an alarm to provide notification of a reduction in the insulation and can request an operator to clean or wash the paint passage.

(4) According to the arrangement of the present invention, the leakage current detection means includes an external current detector for detecting a current that flows along an external surface of the coating machine, and a paint passage current detector for detecting a current that flows along a paint passage within the coating machine.

With this arrangement, a leakage current that flows along the external surface of the coating machine can be detected by using the external surface current detector, and a leakage current that flows along the paint passage can be detected by using the paint passage current detector. Therefore, the power supply cutoff means and the alarm means can recognize a progress of a dielectric breakdown on the external surface of the coating machine and also a dielectric breakdown within the paint passage.

(5) According to the present invention, the coating machine comprises an air motor rotationally driven by drive air, a rotational shaft rotated by the air motor, a rotary atomizing head provided at a distal end of the rotational shaft for spraying paint supplied through a paint supply valve while being rotated by the rotational shaft, and a shaping air ring provided on the outer side of the rotary atomizing head and having air outlet holes for spouting shaping air to form a paint spray pattern, and the leakage current detection means includes a drive air passage current detector for detecting a current that flows along a drive air passage for supplying the drive air, a shaping air passage current detector for detecting a current that flows along a shaping air passage for supplying the shaping air, and a supply valve drive air passage current detector for detecting a current that flows along a supply valve drive air passage to drive openably and closably the paint supply valve.

According to the arrangement in this case, since the leakage current detection means includes the drive air passage current detector, the shaping air passage current detector and the supply valve drive air passage current detector, the leakage currents that flow along the individual air passages can be detected by the three current detectors. Therefore, since the power supply cutoff means and the alarm means can recognize the progress of the dielectric breakdown in the air passages, it can be determined that dust, water, etc., has been deposited and accumulated on the inner walls of the air passages and insulation has been reduced or deteriorated. Therefore, the power supply cutoff means can cut off to supply a high voltage before a dielectric breakdown occurs on the inner wall of each air passage, damage to the air passage can be prevented and the reliability and durability can be improved. Further, before damage to the inner wall of each air passage due to the creepage discharge has advanced, the alarm means can provide notification of a reduction in the insulation by generating an alarm, and can request the operator to perform maintenance of the air passage and the air source, so that cleaning of the filters and the dryers of the air passages and the air sources can be accelerated.

(6) According to the configuration of the present invention, the coating machine comprises an air motor rotationally driven by drive air, a rotational shaft rotated by the air motor, a rotary atomizing head provided at a distal end of the rotational shaft for spraying paint supplied through a paint supply valve while being rotated by the rotational shaft and a shaping air ring provided on the outer side of the rotary atomizing head and having air outlet holes for spouting shaping air to form a paint spray pattern, and the leakage current detection means includes an all air passage current detectors for detecting simultaneously a current that flows along a drive air passage for supplying the drive air, a current that flows along a shaping air passage for supplying the shaping air, and a current that flows along a supply valve drive air passage to drive openably and closably the paint supply valve.

According to the arrangement in this case, since the all air passage current detector included in the leakage current detection means is constituted to detect simultaneously a current that flows along the drive air passage, a current that flows along the shaping air passage and a current that flows along the supply valve drive air passage, a leakage current that flows in all the air passages can be simultaneously detected by employing a single all air passage current detector. Therefore, since the power supply cutoff means and the alarm means can recognize the progress of dielectric breakdown in the air passages, it can be determined that dust, water etc., has been deposited and has accumulated on the inner wall of the air passages, and that insulation has been reduced or deteriorated.

Furthermore, generally, the drive air passage, the shaping air passage and the supply valve drive air passage are connected to the air source that is used in common, and the same air is supplied to all these passages. The factor for the reduction of the insulation in each air passage is the deposition of water in the air and dust (as a fine mist) to the inner wall of the air passage in common. Thus, reductions in the insulation within these air passages tend to occur simultaneously. On the other hand, since the all air passage current detector simultaneously detects (totalizes) the leakage current that flows across all the air passages, a reduction in the insulation in any of the air passages can be detected early and accurately. Furthermore, since a single all air passage current detector is employed for a plural number of air passages, the number of current detectors required can be reduced, compared with the case that a current detector is provided for each of a plural number of air passages. Therefore, the control functions of the power supply cutoff means and the alarm means can be simplified and the manufacturing cost of whole apparatus can be reduced.

(7) According to the arrangement of the present invention, the power supply cutoff means includes object current calculation means for subtracting a leakage current detection value obtained by the leakage current detection means from a full return current detection value obtained by the full return current detection means and calculating an object current that flows between the coating machine and the coating object, and object current abnormality processing means for outputting a cutoff signal to the power supply voltage control unit to cut off the supply of the power supply voltage when the object current obtained by the object current calculation means exceeds a predetermined cutoff threshold current value.

With this, the object current abnormality processing means can determine whether the coating machine has been moved abnormally near the coating object by using the object current which flows between the coating machine and the coating object. When the coating machine has been moved abnormally near, the supply of a power supply voltage can be cut off. In a case that the full return current detection value is employed to determine whether the coating machine has been moved abnormally near the coating object, the approaching condition of the coating object tends to be moderated based on the leakage current and the accuracy tends to be reduced. On the other hand, since the object current abnormality processing means employs the object current which is obtained by subtracting the leakage current detection value from the full return current detection value, in order to determine whether the coating machine has been moved abnormally near the object, the approaching condition of the coating object can be ascertained at a high accuracy.

In addition, since the object current abnormality processing means constantly monitors the object current obtained by subtracting the leakage current detection value, the occurrence of an abnormal leakage current (a leakage current occurred at a location other than a normal one, such as the external surface of the coating machine) inside and outside the coating machine can be monitored indirectly. Therefore, the object current abnormality processing means can find or detect the occurrence of such an abnormal leakage current at an early time.

(8) According to the arrangement of the present invention, the power supply cutoff means includes object current calculation means for subtracting a leakage current detection value obtained by the leakage current detection means from a full return current detection value obtained by the full return current detection means and calculating an object current that flows between the coating machine and the coating object, and a slope abnormality processing means for outputting a cutoff signal to the power supply voltage control unit to cut off the supply of the power supply voltage when a change value of the object current obtained by the object current calculation means exceeds a predetermined cutoff threshold change value.

With this arrangement, the slope abnormality processing means employs the change value in the object current which flows between the coating machine and the coating object to determine whether the coating machine has been moved abnormally near the coating object. When the coating machine has been moved abnormally near, the supply of a power supply voltage can be cut off. In a case that the change value in the full return current detection value is employed to determine whether the coating machine has been moved abnormally near the coating object, the approaching condition of the object tends to be moderated based on the leakage current and the accuracy tends to be reduced. On the other hand, since the slope abnormality processing means employs the change value in the object current which is obtained by subtracting the leakage current detection value from the full return current detection value, in order to determine whether the coating machine has been moved abnormally near the coating object, the approaching condition of the object can be highly accurately ascertained.

BRIEF DESCRIPTION OF THE DRAWINGS

In the accompanying drawings:

FIG. 3 is an explanatory diagram showing a cutoff threshold current value and an alarm threshold current value stored in a high voltage control unit in FIG. 1;

DETAILED DESCRIPTION OF THE INVENTION

Figure 1:
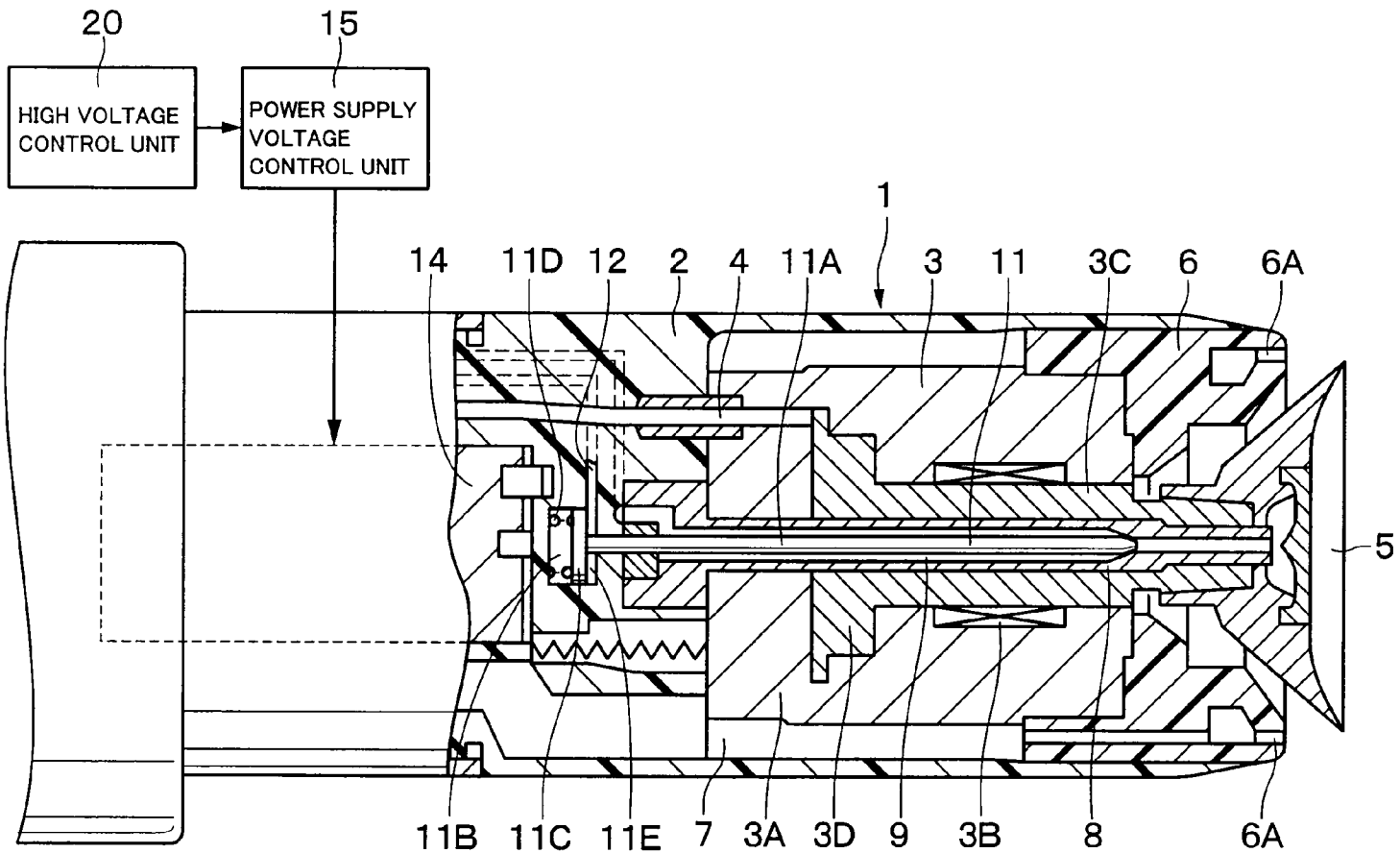
FIG. 1 is a partially cutaway front view of a rotary atomizing head type coating apparatus according to a first embodiment of the present invention.
Figure 2:
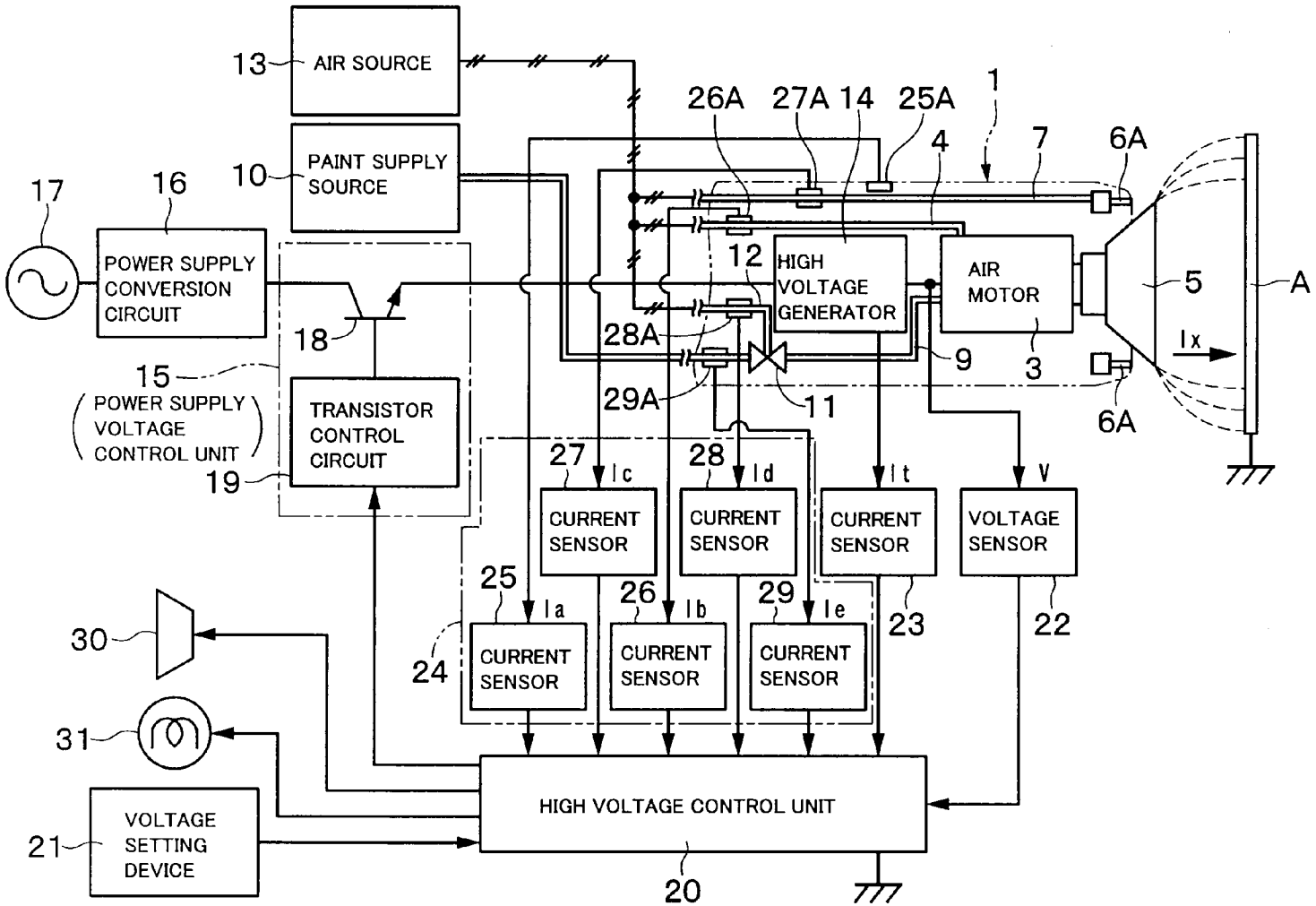
FIG. 2 is a diagram showing the general configuration of the rotary atomizing head type coating apparatus according to the first embodiment.

Hereafter, with reference to the accompanying drawings, the present invention is described more particularly by way of its preferred embodiments which are applied by way of example to a rotary atomizing head type coating apparatus, which is considered as an electrostatic coating apparatus.

Referring first to FIGS. 1 to 5, there is shown a rotary atomizing head type coating apparatus according to a first embodiment. Referring to the drawings, indicated at 1 is a coating machine for spraying paint toward a coating object A at a ground potential. The coating machine 1 includes a cover 2, an air motor 3 and a rotary atomizing head 5, all of which will be described later.

Indicated at 2 is a cylindrical cover formed of an insulating resin. This cover 2 protects the air motor 3, a high voltage generator 14, etc.

Indicated at 3 is an air motor that is composed of a conductive metal accommodated on the inner wall side of the cover 2. The air motor 3 includes a motor housing 3A, a hollow rotational shaft 3C rotatably supported within the motor housing 3A through a hydrostatic air bearing 3B, and an air turbine 3D secured to the base end of the rotational shaft 3C. Further, a drive air passage 4 formed in the coating machine 1 is connected to the air motor 3. When drive air is supplied to the air turbine 3D through the drive air passage 4, the air motor 3 rotates the rotational shaft 3C and the rotary atomizing head 5 at a high speed, 3000 to 150000 rpm, for example.

Denoted at 5 is a rotary atomizing head mounted on the distal end of the rotational shaft 3C of the air motor 3 and made of metal or a conductive resin. When paint is supplied through a feed tube 8, which will be described later, to the rotary atomizing head 5 while rapidly rotated by the air motor 3, the paint is sprayed from the circumferential edge of the rotary atomizing head 5 by centrifugal force. Furthermore, a high voltage generator 14, which will be described later, is connected to the rotary atomizing head 5 through the rotational shaft 3C of the air motor 3, etc. With this arrangement, when electrostatic coating is performed, a high voltage can be applied to the rotary atomizing head 5 and paint that flows along the front surfaces of the rotary atomizing head can be charged directly at a high voltage.

Indicated at 6 is a shaping air ring formed of an insulating resin and arranged at the distal end of the cover 2 to enclose the outer wall of the rotary atomizing head 5. A plural number of air outlet holes 6A are formed in the shaping air ring 6 and communicated with a shaping air passage 7 provided inside the coating machine 1. Shaping air is supplied to the air outlet holes 6A through the shaping air passage 7 and spouted from the air outlet holes 6A toward the paint sprayed from the rotary atomizing head 5. In this manner, the shaping air forms a spray pattern of paint particles that are sprayed from the rotary atomizing head 5.

Indicated at 8 is a feed tube inserted into the rotational shaft 3C, and the distal end of the feed tube 8 projects outward from the distal end of the rotational shaft 3C and is extended inside the rotary atomizing head 5. Furthermore, a paint passage 9 is formed inside the feed tube 8 and connected to a paint supply source 10 and a cleaning thinner supply source (not shown) through a color changing valve unit (not shown). Therefore, while coating, paint from the paint supply source 10 is supplied by the feed tube 8 through the paint passage 9 to the rotary atomizing head 5 and while cleaning or for changing colors, a cleaning fluid (thinner, air, etc.) from the cleaning thinner supply source is supplied by the feed tube 8.

It should be noted that the feed tube 8 is not limited to the arrangement provided for this embodiment. For example, a double tube may be employed wherein a paint passage is formed as an inner tube and a cleaning thinner passage is formed as an outer tube. Further, the paint passage 9 is not limited to the one in this embodiment that passes through inside the feed tube 8, and various passage formats can be employed in consonance with the type of coating machine 1.

Indicated at 11 is a paint supply valve of a normally closed type that is provided on the way of the paint passage 9. The paint supply valve 11 includes a valve body 11A extended inside the paint passage 9, a piston 11C located at the base end of the valve body 11A and formed inside a cylinder 11B, a valve spring 11D formed inside the cylinder 11B and employed to impel the valve body 11A toward the valve closing direction, and a pressure receiving chamber 11E formed in the cylinder 11B on the opposite side of the valve spring 11D. A supply valve drive air passage 12 extended into the cover 2 is connected to the pressure receiving chamber 11E. When supply valve drive air (pilot air) is supplied to the pressure receiving chamber 11E through the supply valve drive air passage 12, the valve body 11A is opened (moved to the left in FIG. 1) by countering the resistance of the valve spring 11D and the flow of paint through the paint passage 9 is permitted.

Denoted at 13 is an air source connected to the drive air passage 4, the shaping air passage 7 and the supply valve drive air passage 12. The air source 13 employs a filter for an intake of exterior air and a compressor for compressing the air, and thereafter, employs a dryer (none of these devices are shown) for the drying and discharge of the compressed air. The compressed air spouted by the air source 13 is supplied to the air motor 3 through a pneumatic-electric transducer (not shown) provided on the way of the drive air passage 4, and the number of revolution of the air motor 3 is controlled by the pneumatic-electric transducer. Further, compressed air spouted by the air source 13 is supplied to the shaping air passage 7 to form a spray pattern of paint particles and also supplied to the supply valve drive air passage 12 to be used for opening and closing the paint supply valve 11.

Indicated at 14 is a high voltage generator incorporated at the base end of the cover 2 and constituted by a cascade rectifying circuit (a so-called Cockcroft circuit) including a plural number of condensers and diodes (none of them are shown). The high voltage generator 14 boosts a power supply voltage supplied by a power supply voltage control unit 15, which will be described later, and generates a high voltage of −30 to −150 kV, for example. Besides, the high voltage generator 14 charges the high voltage directly to the paint that is supplied to the rotary atomizing head 5 through the air motor 3 and the rotary atomizing head 5.

Following this, denoted at 15 is a power supply voltage control unit which controls a DC power supply voltage to be supplied to the high voltage generator 14 to control the voltage (a high voltage) to be output by the high voltage generator 14. The input side of the power supply voltage control unit 15 is connected to a commercial power supply 17 through a power supply conversion circuit 16 and the output side is connected to the high voltage generator 14.

Here, the power supply conversion circuit 16 is constituted, for example, by a high voltage transducer and an A/D converter. The power supply conversion circuit 16 transforms an AC 100 V current supplied by the commercial power supply 17 into a DC 24 V current and outputs this DC 24 V current as a power supply voltage to the power supply voltage control unit 15.

The power supply voltage control unit 15 is constituted by an NPN type power transistor 18 and a transistor control circuit 19 that controls the power transistor 18. The collector of the power transistor 18 is connected to the power supply conversion circuit 16, the emitter is connected to the input side of the high voltage generator 14, and the base is connected to the transistor control circuit 19.

The transistor control circuit 19 changes the base voltage of the power transistor 18 in accordance with a setting signal output by a high voltage control unit 20, which will be described later, and controls to variously change a value of power supply voltage to be applied through the emitter to the input side of the high voltage generator 14.

Denoted at 20 is a high voltage control unit which outputs a signal (a setting signal) in corresponding to a setting voltage which is output by a voltage setting device 21 to designate a power supply voltage for the power supply voltage control unit 15. The high voltage control unit 20 includes a processing unit (CPU), and so forth. The voltage setting device 21, a voltage sensor 22, a current sensor 23 and a leakage current detector 24 are connected to the input side of the high voltage control unit 20, and an alarm buzzer 30 and an alarm lamp 31, which will be described later, are connected to the output side.

The high voltage control unit 20 compares a setting voltage output by the voltage setting device 21 with a voltage detected by the voltage sensor 22, and performs the feedback control for a voltage output by the high voltage generator 14. Through this process, the high voltage control unit 20 outputs a setting signal to the transistor control circuit 19 to control the driving of the power transistor 18 and a high voltage output by the high voltage generator 14 is controlled.

Furthermore, the high voltage control unit 20 is operated in accordance with a program for the high voltage generation control processing shown in FIGS. 4 and 5, which will be described later. Therefore, the high voltage control unit 20 identifies the insulating state of the coating machine 1 by employing current detection values It and Ia to Ie of current sensors 23 and 25 to 29 that will be described later. When the insulating state is identified at the initial stage whereat the insulation is reduced, an alarm signal is output to the alarm buzzer 30 and the alarm lamp 31. When the insulating state is determined to be a deteriorated state, a cutoff signal is output to the power supply voltage control unit 15 to cut off the supply of the power supply voltage to the high voltage generator 14.

It should be noted that the setting voltage output by the voltage setting device 21 is appropriately designated within a range −30 to −150 kV, for example, in accordance with the properties of the paint and the coating condition, and so forth.

Denoted at 22 is a voltage sensor connected to the output side of the high voltage generator 14. The voltage sensor 22 detects a voltage output by the high voltage generator 14 as a voltage for the air motor 3 or the rotary atomizing head 5, and outputs a voltage detection value V to the high voltage control unit 20.

Indicated at 23 is a current sensor served as full return current detection means connected to the high voltage generator 14. The current sensor 23 detects a full return current that flows through the high voltage generator 14 contained in a high voltage application path which is constituted by the commercial power supply 17, the power supply conversion circuit 16, the high voltage generator 14, the rotary atomizing head 5 and the coating object A. At this time, not only an object current which passes along the high voltage application path, but also a leakage current which passes along various leakage paths that will be described later passes through the high voltage generator 14. That is to say, since the high voltage application path and the leakage paths are connected together through the ground line, the both object current and the leakage current return to the high voltage generator 14. Thus, the current sensor 23 detects the full return current which is the sum of the object current and the leakage current, and outputs the obtained current detection value It to the high voltage control unit 20.

Indicated at 24 is a leakage current detector served as leakage current detection means for detecting the flow of a leakage current that does not pass through the coating object A. This leakage current detector 24 is constituted by current sensors 25 to 29, which will be described later, and these output sides are connected to the high voltage control unit 20.

Indicated at 25 is a current sensor that served as an external surface current detector. And, the current sensor 25 is connected to an annular conductive terminal 25A formed of a conductive metallic material that is provided on the surface of the cover 2, for example. In this case, the conductive terminal 25A is located substantially on the same plane as the surface of the cover 2, and formed of an annular conductor that encloses the cover 2. Through the conductive terminal 25A, the current sensor 25 detects a current that flows along the outer surface (the surface of the cover 2) of the coating machine 1, and outputs the obtained current detection value Ia to the high voltage control unit 20.

Indicated at 26 is a current sensor served as a drive air passage current detector. And, the current sensor 26 is connected to an annular conductive terminal 26A that is composed of conductive metallic material provided on the way of the drive air passage 4, for example. In this case, the conductive terminal 26A is formed of an annular conductor and the inner face thereof is located substantially on the same plane as the inner wall of the drive air passage 4. Through the conductive terminal 26A, the current sensor 26 detects a current that flows along the drive air passage 4 in the coating machine 1 and outputs the obtained current detection value Ib to the high voltage control unit 20.

Indicated at 27 is a current sensor served as a shaping air passage current detector. And, the current sensor 27 is connected to the annular conductive terminal 27A that is composed of a conductive metallic material provided on the way of the shaping air passage 7, for example. In this case, the conductive terminal 27A is formed of an annular conductor and the inner face thereof is located substantially on the same plane as the inner wall of the shaping air passage 7. Through the conductive terminal 27A, the current sensor 27 detects a current that flows through the shaping air passage 7 in the coating machine 1 and outputs the obtained current detection value Ic to the high voltage control unit 20.

Indicated at 28 is a current sensor served as a supply valve drive air passage current detector. And, the current sensor 28 is connected to an annular conductive terminal 28A that is composed of a conductive metallic material provided on the way of the supply valve drive air passage 12. In this case, the conductive terminal 28A is formed of an annular conductor that the inner face thereof is located substantially on the same plane as the inner wall of the supply valve drive air passage 12. Through the conductive terminal 28A, the current sensor 28 detects a current that flows through the supply valve drive air passage 12 in the coating machine 1 and outputs the obtained current detection value Id to the high voltage control unit 20.

Indicated at 29 is a current sensor served as a paint passage current detector. And, the current sensor 29 is connected to an annular conductive terminal 29A that is composed of a conductive metallic material located upstream (the side of the paint supply source 10) than the paint supply valve 11 and provided on the way of the paint passage 9. In this case, the conductive terminal 29A is formed of an annular conductor that the inner face thereof is located substantially on the same plane as the inner wall of the paint passage 9. Through the conductive terminal 29A, the current sensor 29 detects a current that flows through the paint passage 9 in the coating machine 1 and outputs the obtained current detection value Ie to the high voltage control unit 20.

Indicated at 30 is an alarm buzzer and 31 is an alarm lamp. The alarm buzzer 30 and the alarm lamp 31 constitute alarm means and connected to the output side of the high voltage control unit 20. The alarm buzzer 30 and the alarm lamp 31 are driven based on an alarm signal output by the high voltage control unit 20, and notify the operator that insulation on the cover 2 and so forth has been reduced.

Being arranged in the manner as described above, the rotary atomizing head type coating apparatus of the first embodiment operates in the manner as described below.

The coating machine 1 employs the air motor 3 to rotate the rotary atomizing head 5 at high speed, and in this state, paint is supplied to the rotary atomizing head 5 through the feed tube 8. Then, by using the centrifugal force produced by the rotation of the rotary atomizing head 5, the coating machine 1 atomizes and sprays the paint. Further, since shaping air is supplied through the shaping air ring 6, the paint particles are deposited to the coating object and the spray pattern is controlled.

Furthermore, by use of the high voltage generator 14, a high voltage is applied to the rotary atomizing head 5 through the air motor 3. Thus, not only the paint particles are directly charged at a high voltage through the rotary atomizing head 5, but they also fly along the electrostatic field formed between the rotary atomizing head 5 and the coating object A, and are deposited to the coating object A.

Figure 4:
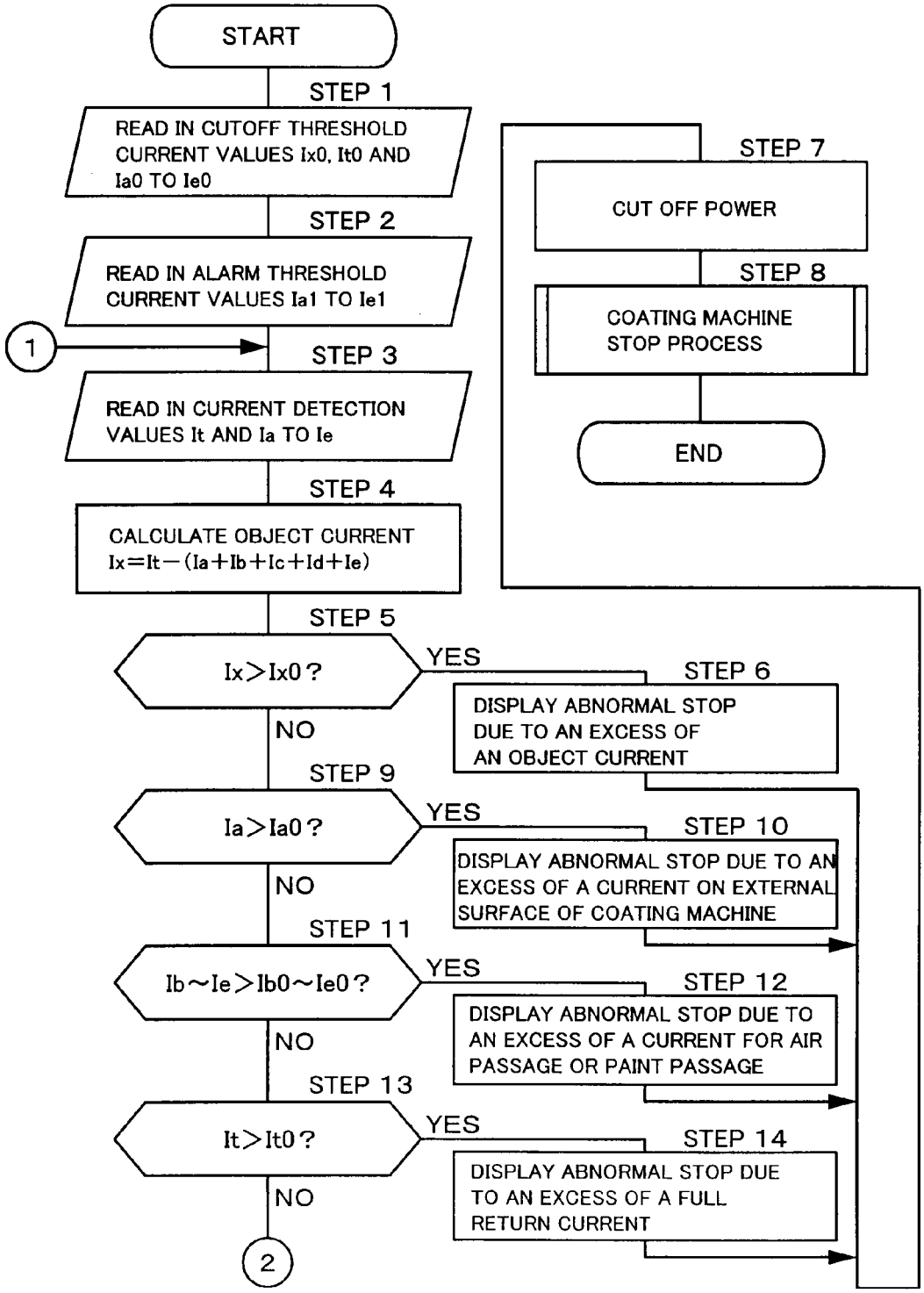
FIG. 4 is a flowchart showing the high voltage generation control processing according to the first embodiment.
Figure 5:
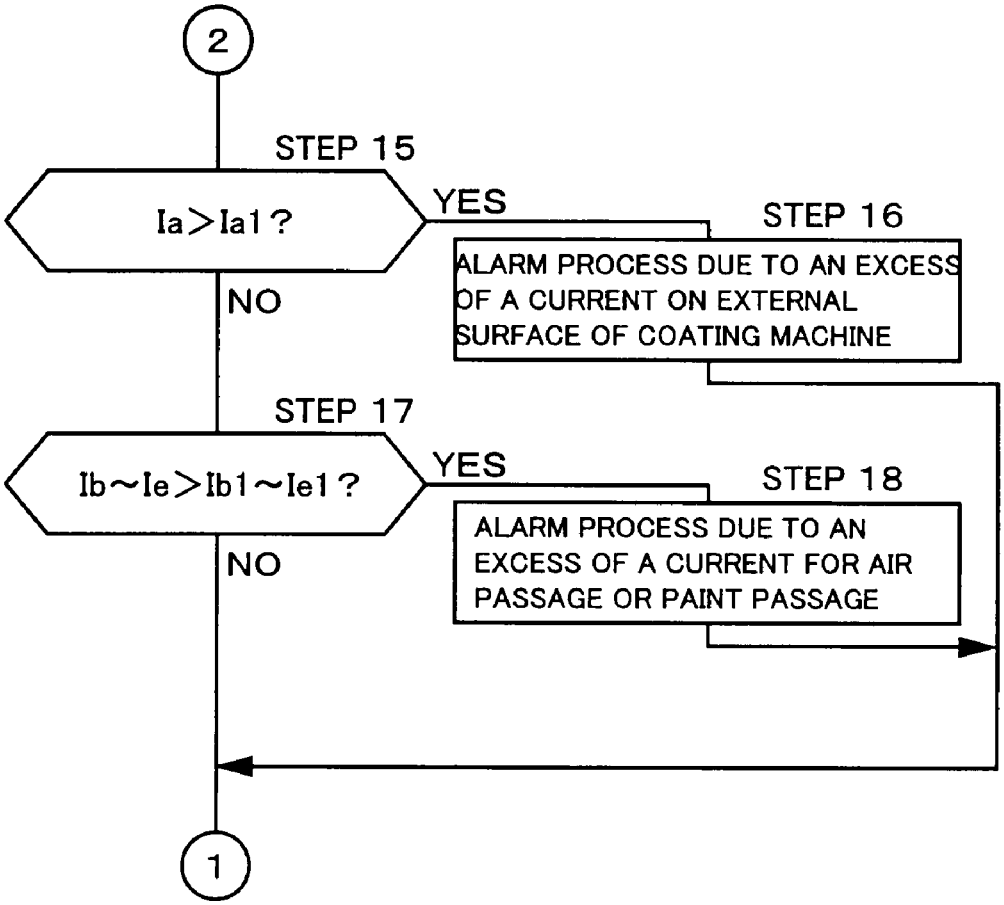
FIG. 5 is a flowchart showing the continuation of FIG. 4.

Referring to FIGS. 4 and 5, the high voltage generation control processing performed by the high voltage control unit 20 will now be explained.

It should be noted that a cutoff threshold current value It0 is a value for a full return current that flows through the high voltage generator 14 in the state wherein the rotary atomizing head 5 is moved abnormally near the coating object A, or the state wherein the insulation of the cover 2 is deteriorated. The cutoff threshold current value It0 is set, for example, to about 200 μA.

Further, a cutoff threshold current value Ix0 is a value for an object current that flows between the coating machine 1 and the coating object A in a state wherein the rotary atomizing head 5 is moved abnormally near the coating object A and insulation is deteriorated. The cutoff threshold current value Ix0 is set, for example, to about 80 μA. The cutoff threshold current value Ia0 is the value of a current that flows along the external surface of the cover 2 in a state wherein the insulation of the cover 2 is deteriorated. The cutoff threshold current value Ia0 is set, for example, to about 60 μA. In addition, cutoff threshold current values Ib0 to Id0 are values for a current that flows along the air passages 4, 7 and 12 in states wherein the insulation for the individual air passages 4, 7 and 12 is deteriorated. The cutoff threshold current values Ib0 to Id0 are set, for example, to about 10 μA. A cutoff threshold current value Ie0 is the value of a current that flows along the paint passage 9 in a state wherein the insulation of the paint passage 9 is deteriorated. A cutoff threshold current value Ie0 is set, for example, to about 15 μA.

On the other hand, alarm threshold current values Ia1 to Ie1 are respectively set to smaller values than the cutoff threshold current values Ia0 to Ie0 (e.g., values of about 60 to 80% of the cutoff threshold current value It0).

Here, the alarm threshold current value Ia1 is a value of a current that flows along the external surface of the cover 2 in the initial state wherein the insulation of the cover 2 is reduced (the state wherein the insulation of the cover 2 is liable to be lost). The alarm threshold current value Ia1 is set, for example, to about 40 μA, which is a value smaller than the cutoff threshold current value Ia0. Likewise, the alarm threshold current values Ib1 to Id1 are values for currents that flow along the individual air passages 4, 7 and 12 in the initial state wherein the insulation of the air passages 4, 7 and 12 is deteriorated. The alarm threshold current values Ib1 to Id1 are respectively set, for example, to about 6 μA, which is smaller than the cutoff threshold current values Ib0 to Id0. An alarm threshold current value Ie1 is a value for a current that flows along the paint passage 9 in the initial state wherein the insulation of the paint passage 9 is reduced. The alarm threshold current value Ie1 is set, for example, to about 10 μA, which is smaller than the cutoff threshold current value Ie0.

The cutoff threshold current values It0, Ix0 and Ia0 to Ie0 and the alarm threshold current values Ia1 to Ie1 described above are collectively shown as a datamap in FIG. 3.

Firstly, at step 1, the cutoff threshold current values It0, Ix0 and Ia0 to Ie0 for the detection of an absolute value are read in data shown in FIG. 3 stored in the memory (not shown) of the high voltage control unit 20 in advance. At step 2, the alarm threshold current values Ia1 to Ie1 for the detection of an absolute value are read in the data shown in FIG. 3 stored in the memory in advance, and at step 3, the current detection values It and Ia to Ie detected by the current sensors 23 and 25 to 29 are read.

Following this, at step 4, based on the following expression (1), the leakage current detection values Ia to Ie are subtracted from the full return current detection value It to obtain a object current value Ix flowing between the coating machine 1 and the coating object A.

$$Ix=It-(Ia+Ib+Ic+Id+Ie) \quad (1)$$

Sequentially, at step 5, a check is performed to determine whether the object current value Ix obtained at step 4 is greater than a predesignated cutoff threshold current value Ix0 (Ix>Ix0). When the decision at step 5 is "YES", the insulation is deteriorated because the rotary atomizing head 5 has been moved abnormally near the coating object A, and a current that flows between the coating machine 1 and the coating object A is increased as much as a breakdown is caused. Therefore, the processing is shifted to step 6, and an abnormal stop indication indicating the excess of object current value Ix is output, for example, to the monitor (not shown) of the high voltage control unit 20.

Thereafter, at step 7, the high voltage control unit 20 outputs a cutoff signal to the power supply voltage control unit 15 and drives the transistor control circuit 19 to disconnect the high voltage generator 14 from the power supply conversion circuit 16 and cut off the supply of a high voltage. Finally, at step 8, the process to stop the coating machine 1 is performed and the processing is terminated.

On the other hand, when the decision at step 5 is "NO", the processing is shifted to step 9. At step 9, a check is performed to determine whether a current detection value Ia that flows along the surface of the cover 2 is greater than a predesignated cutoff threshold current value Ia0 (Ia>Ia0). When the decision at step 9 is "YES", the insulation is deteriorated because the creepage discharge, for example, has occurred due to a substance deposited to the cover 2 and a current that flows along the surface of the cover 2 is increased as much as the breakdown is caused. Therefore, the processing is shifted to step 10 and an abnormal stop indication indicating the excess of the current detection value Ia detected at the surface of the cover 2 has been output, for example, to the monitor (not shown) of the high voltage control unit 20. Thereafter, the processing is shifted to step 7, whereat the high voltage generator 14 is disconnected from the power supply conversion circuit 16 to cut off the supply of a high voltage. And the processing is shifted to step 8, whereat the process to stop the coating machine 1 is performed and the processing is terminated.

On the other hand, when the decision at step 9 is "NO", the processing is shifted to step 11. At step 11, a check is performed to determine whether the current detection values Ib to Id that flow through the air passages 4, 7 and 12 and the current detection value Ie that flows through the paint passage 9 are greater than predesignated cutoff threshold current values Ib0 to Ie0, respectively (Ib>Ib0, Ic>Ic0, Id>Id0, Ie>Ie0). When the decision at step 11 is "YES", the insulation is lost because the creepage discharge, for example, has occurred due to water, dust, etc., being deposited to the inside of the air passages 4, 7 and 12, and a current that flows along one of the air passages 4, 7 and 12 has been increased as much as a dielectric breakdown is occurred. Alternatively, the insulation is deteriorated because the creepage discharge, for example, has occurred due to the pigment, etc., deposited to the inside of the paint passage 9, and the current that flows through the paint passage 9 is increased as much as the dielectric breakdown is occurred. Therefore, the processing is shifted to step 12 and an abnormal stop indication indicating a passage for one of the current detection values Ib to Ie is output to the monitor (not shown) of the high voltage control unit 20. Thereafter, the processing is shifted to step 7, whereat the high voltage generator 14 is disconnected from the power supply conversion circuit 16 to cut off the supply of a high voltage, and the processing is shifted to step 8, whereat the process is performed to stop the coating machine 1 and the processing is terminated.

On the other hand, when the decision at step 11 is "NO", the processing is shifted to step 13. At step 13, a check is performed to determine whether the current detection value It of a full return value that flows through the high voltage generator 14 is greater than a predesignated cutoff threshold value It0 (It>It0). When the decision at step 13 is "YES", the current detection value It has been increased as much as the dielectric breakdown may occur. Thus, the processing is shifted to step 14, and an abnormal stop indication indicating the excess of the current detection value It of the full return current is output, for example, to the monitor (not shown) of the high voltage control unit 20. Thereafter, the processing is shifted to step 7, whereat the high voltage generator 14 is disconnected from the power supply conversion circuit 16 to cut off the supply of a high voltage and the processing is shifted to step 8, whereat the process to stop the coating machine 1 is performed and the processing is terminated.

On the other hand, when the decision at step 13 is "NO", since the decisions at steps 5, 9, 11 and 13 are also "NO", the current detection values Ia to Ie and It and the object current value Ix are equal to or smaller than the cutoff threshold current values Ia0 to Ie0, It0 and Ix0. Therefore, it is assumed that the current detection value Ia to Ie and It and the object current value Ix are small as much as coating can be continued, and the processing is shifted to step 15.

Next, at step 15, a check is performed to determine whether the current detection value Ia that flows along the surface of the cover 2 is greater than a predesignated alarm threshold current value Ia1 (Ia>Ia1). When the decision at step 15 is "YES", coating can be continued, but the creepage discharge is generated by a substance deposited to the cover 2 and the insulation is reduced. Therefore, the processing is shifted to step 16 and an alarm signal is output to the alarm buzzer 30 and the alarm lamp 31, and indicating the reduction of the insulation of the cover 2 because of increasing the current detection value on the monitor (not shown) of the high voltage control unit 20. By employing these procedures, maintenance (e.g., checking or cleaning) of the surface of the cover 2 is requested of the operator. Thereafter, the processes following step 3 are repeated.

On the other hand, when the decision at step 15 is "NO", the processing is shifted to step 17. At step 17, a check is performed to determine whether the current detection values Ib to Id that flow through the air passages 4, 7 and 12 and the current detection value Ie that flows through the paint passage 9 are greater than predesignated alarm threshold current values Ib1 to Ie1, respectively (Ib>Ib1, Ic>Ic1, Id>Id1, Ie>Ie1). When the decision at step 17 is "YES", the coating can be continued, however the insulation is reduced because the creepage discharge has been occurred as a result of water, dust, etc., deposited to the inside of the air passages 4, 7 and 12, or the creepage discharge has been occurred due to the pigment, etc., deposited to the inside of the paint passage 9. Therefore, the processing is shifted to step 18 and an alarm signal is output to the alarm buzzer 30 and the alarm lamp 31, and indicating the passage reduced the insulation among the air passage 4, 7 or 12 or the paint passage 9 on the monitor (not shown) of the high voltage control unit 20. In this manner, the air passage 4, 7 or 12, or the paint passage 9 for which the insulation has been reduced is notified to the operator and maintenance of the passage is requested. Thereafter, the processes following step 3 are repeated.

However, when the decision at step 17 is "NO", it is assumed that all the current detection values Ia to Ie are smaller than the alarm threshold current values Ia1 to Ie1 and maintained in the normal coating state. Therefore, while the current state is maintained, the processing is shifted to step 3 and the processes following step 3 are repeated.

The rotary atomizing head type coating apparatus for the first embodiment is operated based on the high voltage generation control processing described above.

Therefore, according to this embodiment, provided are, the current sensor 23 which detects a full return current that flows through the high voltage generator 14, and the leakage current detector 24 which detects a leakage current that flows without passing through the coating object A. Thus, when the high voltage control unit 20 determines whether the current detection value It obtained by the current sensor 23 is greater than the predetermined cutoff threshold current value It0 or whether the current detection values Ia to Ie obtained by the leakage current detector 24 is greater than the predetermined cutoff threshold current values Ia0 to Ie0, whether the insulation of the coating machine 1 has been deteriorated as much as a dielectric breakdown might occur can be determined.

Thus, the high voltage control unit 20 can employ the current detection value It to determine that the coating machine 1 has been moved abnormally near the coating object A and the insulation of the coating machine 1 has been deteriorated. Further, the high voltage control unit 20 can employ the current detection values Ia to Ie to determine that the insulation has been deteriorated at places such as the surface of the cover 2 of the coating machine 1, the inner walls of the air passages 4, 7 and 12 and the inner wall of the paint passage 9 that flows the leakage current without passing through the coating object A.

Furthermore, the high voltage control unit 20 employs the current detection values Ia to Ie obtained by the leakage current detector 24 to notify the reduction in the insulation of the coating machine 1. Therefore, the high voltage control unit 20 can determine whether the current detection values Ia to Ie exceed the predetermined alarm threshold current values Ia1 to Ie1 which are smaller than the cutoff threshold current values Ia0 to Ie0, so that whether an initial insulation reduction has occurred before the insulation of the coating machine 1 is deteriorated.

As a result, by using the current detection values Ia to Ie, the high voltage control unit 20 can recognize the progress of the breakdown locations (e.g., the surface of the cover 2 of the coating machine 1, the inner walls of the air passages 4, 7 and 12, the inner wall of the paint passage 9) other than the area between the coating object A and the coating machine 1. Therefore, before damage occurs due to the creepage discharge at the individual locations, an alarm can be generated to request the maintenance and cleaning of the coating machine 1, so that damage to the coating machine 1 can be prevented and the reliability and durability can be improved.

Especially, for the arrangement of the first embodiment, the leakage current detector 24 includes the current sensors 25 to 29 which individually detect leakage currents, for example, at the surface of the cover 2 of the coating machine 1, the inner walls of the air passages 4, 7 and 12 and the inner wall of the paint passage 9. Therefore, of a plural number of locations whereat to detect a leakage current, the high voltage control unit 20 can identify a location whereat the leakage current is increased (a location whereat the insulation has been reduced). As a result, the operator need only maintain or clean the area of the coating machine 1 identified by the high voltage control unit 20, the associated device and so forth.

Specifically, when the current detection value Ia obtained by the current sensor 25 is increased and when the high voltage control unit 20 generates an alarm or cuts off the supply of a high voltage, it is assumed that a substance has accumulated on the surface of the cover 2 of the coating machine 1. Therefore, the operator need only to clean the surface of the cover 2 of the coating machine 1.

Further, when the current detection values Ib to Id obtained by the current sensors 26 to 28 are increased and when the high voltage control unit 20 generates an alarm and cuts off the supply of a high voltage, it is assumed that water, dust, etc., has been deposited to the inner wall of the drive air passage 4, the shaping air passage 7 or the supply valve drive air passage 12. Thus, only one of passages identified by the high voltage control unit 20 need clean, and the filter, the dryer, etc., of the air source 13, which supplies air to the air passages 4, 7 and 12, must be inspected, cleaned or exchanged.

In addition, when the current detection value Ie obtained by the current sensor 29 is increased, and when the high voltage control unit 20 generates an alarm or cuts off the supply of a high voltage, it is assumed that a pigment, etc., of paint has been deposited to the inner wall of the paint passage 9. Thus, the operator needs to clean only the paint passage 9 of the coating machine 1 by use of a thinner.

As described above, maintenance, cleaning, etc., is required only for a location whereat the insulation has been reduced and the leakage current has been generated, so that the interrupted time by the cleaning of the coating machine 1, etc., can be reduced and the coating productivity can be improved.

Further, the high voltage control unit 20 is constituted to calculate the object current value Ix that flows between the coating object A and the coating machine 1 and outputs a cutoff signal to the power supply voltage control unit 15 when the object current value Ix exceeds the predetermined cutoff threshold current value Ix0. Therefore, the high voltage control unit 20 employs the object current value Ix to determine whether the coating machine 1 has been moved abnormally near the coating object A, and when it is determined that the coating machine 1 is abnormally near, the supply of a power supply voltage to the high voltage generator 14 can be cut off.

In addition, in case of the prior art, as the full return current detection value It is employed to determine whether the coating machine 1 has been moved abnormally near the coating object A, the approaching condition relative to the coating object A tends to be alleviated based on the leakage current, and the accuracy tends to be reduced. On the other hand, in this embodiment, the object current value Ix subtracted the leakage current detection values Ia to Ie from the full return current detection value It is employed to determine whether the coating machine 1 has been moved abnormally near the coating object A. Thus, the approaching condition relative to the coating object A can be highly accurately obtained. As a result, since unnecessary interruptions during the coating can be prevented, and since a coating failures for the coating object A can be avoided, the coating productivity can be improved.

In addition, the high voltage control unit 20 can always monitor the object current value Ix subtracted the leakage current detection values Ia to Ie. Therefore, the high voltage control unit 20 can indirectly monitor whether an abnormal leakage current has occurred inside and outside the coating machine 1 (locations other than the usual locations, such as the external surface of the coating machine 1, whereat the leakage current occurs). Therefore, the occurrence of such an abnormal leakage current can be detected or identified at an early time and checking or repairing can be requested before the coating machine 1 is damaged.

Figure 6:
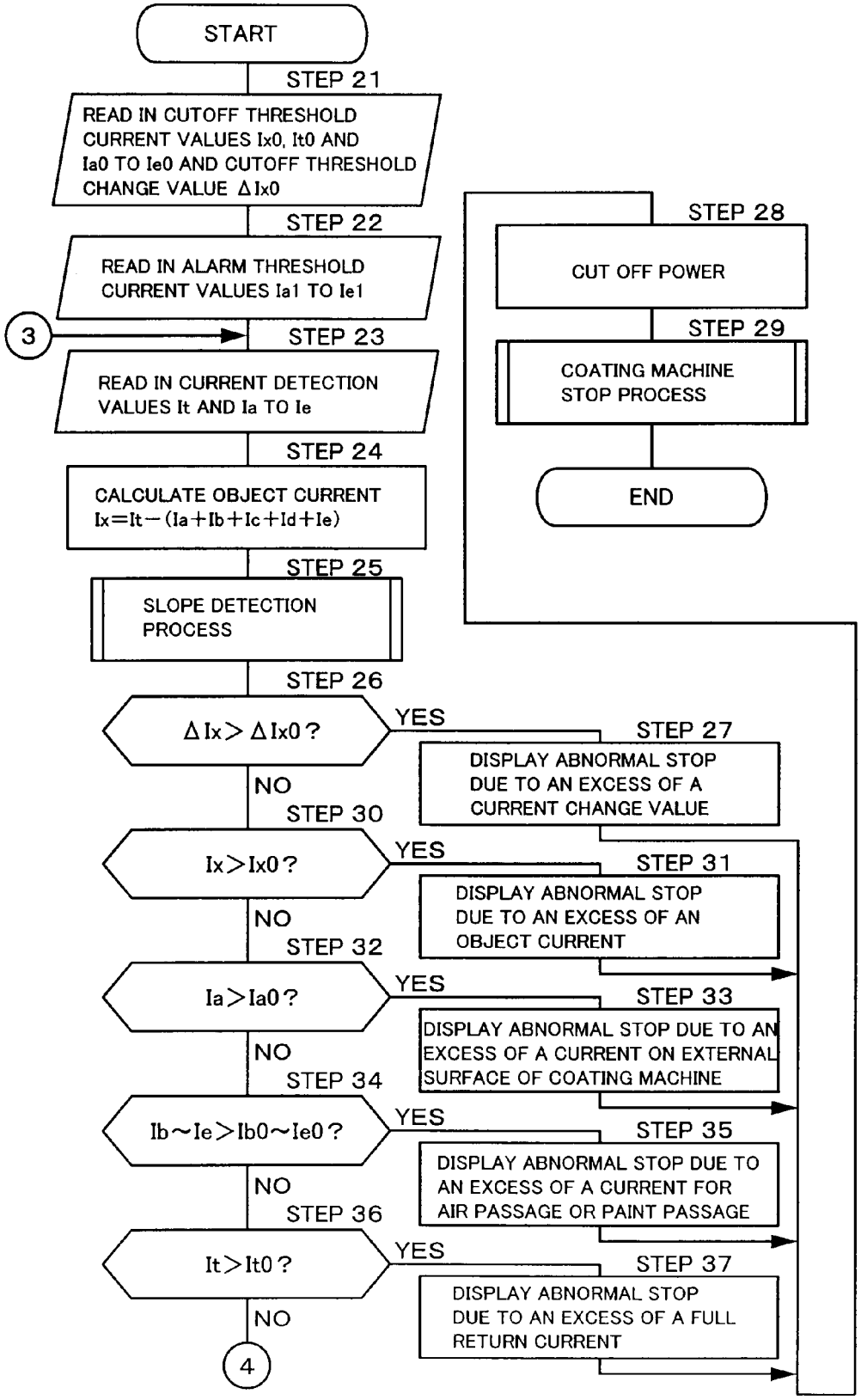
FIG. 6 is a flowchart showing the high voltage generation control processing according to a second embodiment.
Figure 7:
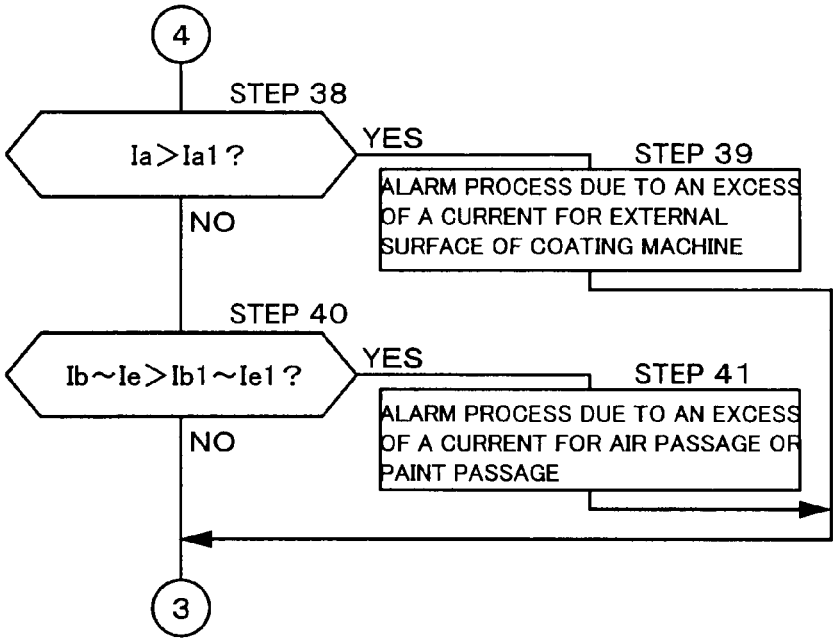
FIG. 7 is a flowchart showing the continuation of FIG. 6.
Figure 8:
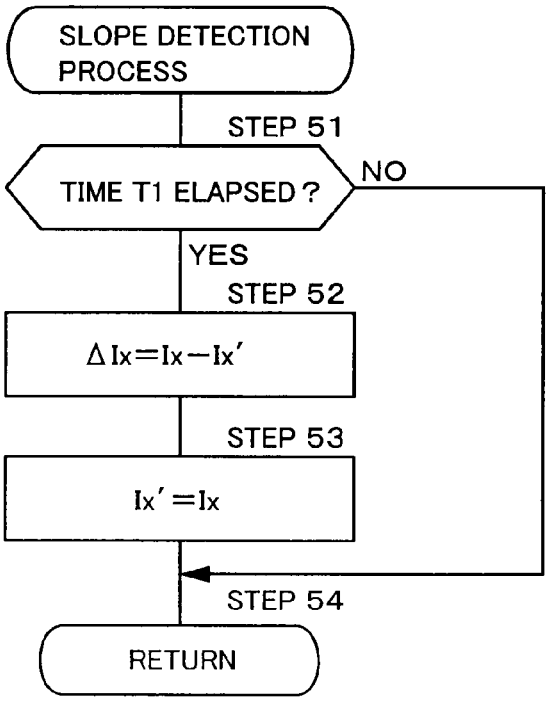
FIG. 8 is a flowchart showing a slope detection process in FIG. 6.

Turning now to FIGS. 6 to 8, there is shown the high voltage generation control processing according to a second embodiment. The feature of this embodiment resides in that a slope abnormality process is performed when the amount of change in an object current exceeds a predetermined amount for a cutoff threshold change value, a cutoff signal is output to a power supply voltage control unit to cut off the supply of a power supply voltage. In the following description of the second embodiment, those component parts that are identical with the counter parts in the foregoing first embodiment are simply designated by the same reference numerals or characters to avoid repetitions of same explanations.

Furthermore, cutoff threshold current values It0, Ix0 and Ia0 to Ie0 and alarm threshold current values Ia1 to Ie1 are set in the same manner as in the first embodiment, and are stored in the memory (not shown) of a high voltage control unit 20 as shown in FIG. 3.

Further, the object current value, for example, for every 170 ms used for slope detection is stored as Ix' in the memory (not shown) of the high voltage control unit 20. Furthermore, a value of about 4 to 40 μA (e.g., about 15 μA) is set as a cutoff threshold change value ΔIx0, which is the value of change represented by the value Ix of the object current that flows between the coating machine 1 and the coating object A when the rotary atomizing head 5 has been moved abnormally near the coating object. And, the cutoff threshold change value ΔIx0 is stored in the memory of the high voltage control unit 20.

Firstly, at step 21, the cutoff threshold current values It0, Ix0 and Ia0 to Ie0 for the detection of an absolute value, and the cutoff threshold change value ΔIx0, all of which are stored in the memory in advance, are read in. At step 22, the alarm threshold current values Ia1 to Ie1 for the detection of an absolute value stored in advance in the memory are read in. And at step 23, current detection values It and Ia to Ie detected by the current sensors 23 and 25 to 29 are read in.

Following this, at step 24, based on expression (1), the leakage current detection values Ia to Ie are subtracted from the detection value It of the full return current, and as in the first embodiment, the value Ix of the object current that flows between the coating machine 1 and the coating object A is obtained.

Next, at step 25, the slope detection process, which will be described later, is performed, and a change value ΔIx of the object current value Ix for every 170 ms is calculated in accordance with expression (2), which will be described later. Then, the processing is shifted to step 26.

Sequentially, at step 26, a check is performed to determine whether the change value ΔIx of the object current value Ix is greater than a predesignated cutoff threshold change value ΔIx0 (ΔIx>ΔIx0). When the decision at step 26 is "YES", the rotary atomizing head 5 is tend to be moved abnormally near the coating object A and a current that flows between the coating machine 1 and the coating object A is greatly increased within a short period of time. Therefore, the processing is shifted to step 27 and an abnormal stop indication indicating the excess of the change value ΔIx of the object current is output, for example, to the monitor (not shown) of the high voltage control unit 20. Thereafter, the processing is shifted to step 28, and a transistor control circuit 19 is driven and a high voltage generator 14 is disconnected from a power supply conversion circuit 16 to cut off the supply of a high voltage. Then, the processing is shifted to step 29 and the process to stop the coating machine 1 is performed and the processing is terminated.

On the other hand, when the decision at step 26 is "NO", the program is shifted to step 30 and a check is performed to determine whether the object current value Ix is greater than a predesignated cutoff threshold current value Ix0 (Ix>Ix0). When the decision at step 30 is "YES", the insulation is deteriorated because the rotary atomizing head 5 has been moved abnormally near the coating object A and a current that flows between the coating machine 1 and the coating object A is so greatly increased as much as a dielectric breakdown would occur. Therefore, the processing is shifted to step 31 and an abnormal stop indication indicating the excess of the object current value Ix is displayed, for example, on the monitor (not shown) of the high voltage control unit 20. Thereafter, at step 28, the high voltage control unit 20 outputs a cutoff signal to the power supply voltage control unit 15 to disconnect the high voltage generator 14 from the power supply conversion circuit 16 and cut off the supply of a high voltage. Finally, at step 29, the process to stop the coating machine 1 is performed and the processing is terminated.

On the other hand, when the decision at step 30 is "NO", the processing is shifted to step 32. At step 32, a check is performed to determine whether the current detection value Ia that flows across the surface of the cover 2, etc., is greater than a predesignated cutoff threshold current value Ia0 (Ia>Ia0). When the decision at step 32 is "YES", the insulation is deteriorated because a creepage discharge has occurred due to a substance deposited to the cover 2, etc., and the current that flows along the surface of the cover 2 is increased as much as a dielectric breakdown will occur. Therefore, the processing is shifted to step 33 and an abnormal stop indication indicating excess of the current detection value Ia detected at the surface of the cover 2 is output, for example, to the monitor (not shown) of the high voltage control unit 20. Thereafter, the processing is shifted to step 28 and the high voltage generator 14 is disconnected from the power supply conversion circuit 16 to cut off the supply of a high voltage. Then, the processing is shifted to step 29 and the process to stop the coating machine 1 is performed and the processing is terminated.

On the other hand, when the decision at step 32 is "NO", the processing is shifted to step 34. And, a check is performed to determine whether the detection values Ib to Id of the currents that flow through air passages 4, 7 and 12 and the detection value Ie of the current that flows through a paint passage 9 are greater than predesignated cutoff threshold current values Ib0 to Ie0, respectively (Ib>Ib0, Ic>Ic0, Id>Id0, Ie>Ie0). When the decision at step 34 is "YES", the insulation is deteriorated because a creepage discharge, for example, has occurred due to water, dust, etc., deposited to the air passage 4, 7 or 12, and the current that flows through one of the air passages 4, 7 and 12 is increased as much as a dielectric breakdown will occur. Otherwise, the insulation is deteriorated because the creepage discharge has occurred as a result of the pigment, etc., deposited to the interior of the paint passage 9 and the current that flows through the paint passage 9 is increased as much as a dielectric breakdown would occur. Therefore, the processing is shifted to step 35 and an abnormal stop indication for indicating a passage of the excessibly large current detection value among the passages of the current detection values Ib to Ie, is output to the monitor (not shown) of the high voltage control unit 20. Thereafter, the processing is shifted to step 28 and the high voltage generator 14 is disconnected from the power supply conversion circuit 16 to cut off the supply of a high voltage. The processing is then shifted to step 29 and the process to stop the coating machine 1 is performed and the processing is terminated.

On the other hand, when the decision at step 34 is "NO", the processing is shifted to step 36. And, a check is performed to determine whether the current detection value It of the full return current that flows through the high voltage generator 14 is greater than a predesignated cutoff threshold current value It0 (It>It0). When the decision at step 36 is "YES", it is assumed that the current detection value It has been increased as much as a dielectric breakdown would occur. Thus, the processing is shifted to step 37 and an abnormal stop indication indicating the excess of the current detection value It of the full return current is output to the monitor (not shown) of the high voltage control unit 20. Thereafter, the processing is shifted to step 28 and the high voltage generator 14 is disconnected from the power supply conversion circuit 16 to cut off the supply of a high voltage. The processing is then shifted to step 29 and the process to stop the coating machine 1 is performed and the processing is terminated.

On the other hand, when the decision at step 36 is "NO", it is assumed that the change value ΔIx of the object current, the current detection values Ia to Ie and It and the object current value Ix are small as much as coating can be continued. Thus, the processing is shifted to step 38.

Following this, at step 38, a check is performed to determine whether the detection value Ia of the current that flows along the surface of the cover 2 is greater than a predesignated alarm threshold current value Ia1 (Ia>Ia1). When the decision at step 38 is "YES", the coating can be continued. However, a creepage discharge has occurred as a result of the substance deposited to the cover 2, the insulation is reduced. Therefore, the processing is shifted to step 39 and an alarm signal is output to an alarm buzzer 30 and an alarm lamp 31. In addition, the reduction of the insulation of the cover 2 because of increasing the current detection value Ia is displayed on the monitor (not shown) of the high voltage control unit 20. By employing these, maintenance (e.g., checking, cleaning) of the surface of the cover 2 can be requested to the operator. Thereafter, the processes following step 23 are repeated.

On the other hand, when the decision at step 38 is "NO", the processing is shifted to step 40. At step 40, a check is performed to determine whether the current detection values Ib to Id that flow through the air passages 4, 7 and 12 and the current detection value Ie that flows through the paint passage 9 are greater than predesignated alarm threshold current values Ib1 to Ie1, respectively (Ib>Ib1, Ic>Ic1, Id>Id1, Ie>Ie1). When the decision at step 40 is "YES", the coating can be continued. However, the insulation is deteriorated because a creepage discharge has occurred due to water, dust, etc., deposited to the inside the air passage 4, 7 or 12, or because the creepage discharge has occurred due to the pigment, etc., deposited to the inside the paint passage 9. Therefore, the processing is shifted to step 41, and an alarm signal is output to the alarm buzzer 30 and the alarm lamp 31. Further, the passage reduced the insulation among the air passages 4, 7 and 12 and the paint passage 9 is displayed on the monitor (not shown) of the high voltage control unit 20. In this manner, the passage reduced the insulation among the air passages 4, 7 and 12 and the paint passage 9 can be notified to the operator and maintenance of the pertinent passage requested. Thereafter, the processes following step 23 are repeated.

On the other hand, when the decision at step 40 is "NO", it is assumed that all of the current detection values Ia to Ie are smaller than the alarm threshold current values Ia1 to Ie1 and that they are being maintained in the normal coating condition. Therefore, while keeping this condition, the processing is shifted to step 23 and the processes following step 23 are repeated.

Next, the slope detection process at step 25 will be described while referring to FIG. 8. At step 51, a check is performed to determine whether a setting time T1 of about 170 ms, for example, has elapsed as a period of time T1 that has been designated to detect a time-transient change in a current. When the decision at step 51 is "NO", the processing is shifted to step 54 and returns without performing any action.

On the other hand, when the decision at step 51 is "YES", the processing is shifted to step 52 and a difference between a present object current value Ix and the preceding (170 ms before) object current value Ix' is calculated based on the following expression (2) and the difference is obtained as a change value ΔIx of the object currents for slope detection by employing current vibrations. Thereafter, the processing is shifted to step 53 and the object current value Ix' stored in the memory is updated as the present object current value Ix (Ix'=Ix). Then, the processing is shifted to step 54 and returns. In this manner, a change value ΔIx of the object current for each setting time T1 can be calculated.

$$\Delta Ix = Ix - Ix' \tag{2}$$

As a result, in the second embodiment, the same operational effects as in the foregoing first embodiment can be obtained. Especially in the arrangement for this embodiment, when the change value ΔIx of the object current value exceeds the predetermined cutoff threshold change value ΔIx0, a cutoff signal is output to the power supply voltage control unit 15 to cut off the supply of a power supply voltage. Therefore, whether the coating machine 1 has been moved abnormally near the coating object A can be determined by employing the change value ΔIx in the object current value that flows between the coating machine 1 and the coating object A. When the coating machine 1 has been moved abnormally near, the supply of a power supply voltage to the high voltage generator 14 can be cut off.

On the other hand, in a case that the change value of the full return current detection value It is employed to determine whether a coating machine has been abnormally near to the coating object A as in the prior art, the approaching condition relative to the coating object A is relieved based on the leakage current and the accuracy tends to be reduced. On the other hand, in this embodiment, an abnormal approach of the coating machine 1 to the coating object A is determined by employing the change value ΔIx in the object current value Ix which is obtained by subtracting the leakage current detection values Ia to Ie from the full return current detection value It. Therefore, the approaching condition relative to the coating object A can be recognized at a high accuracy. Thus, unnecessary interruptions of the coating can be avoided and the coating productivity can be improved.

Figure 9:
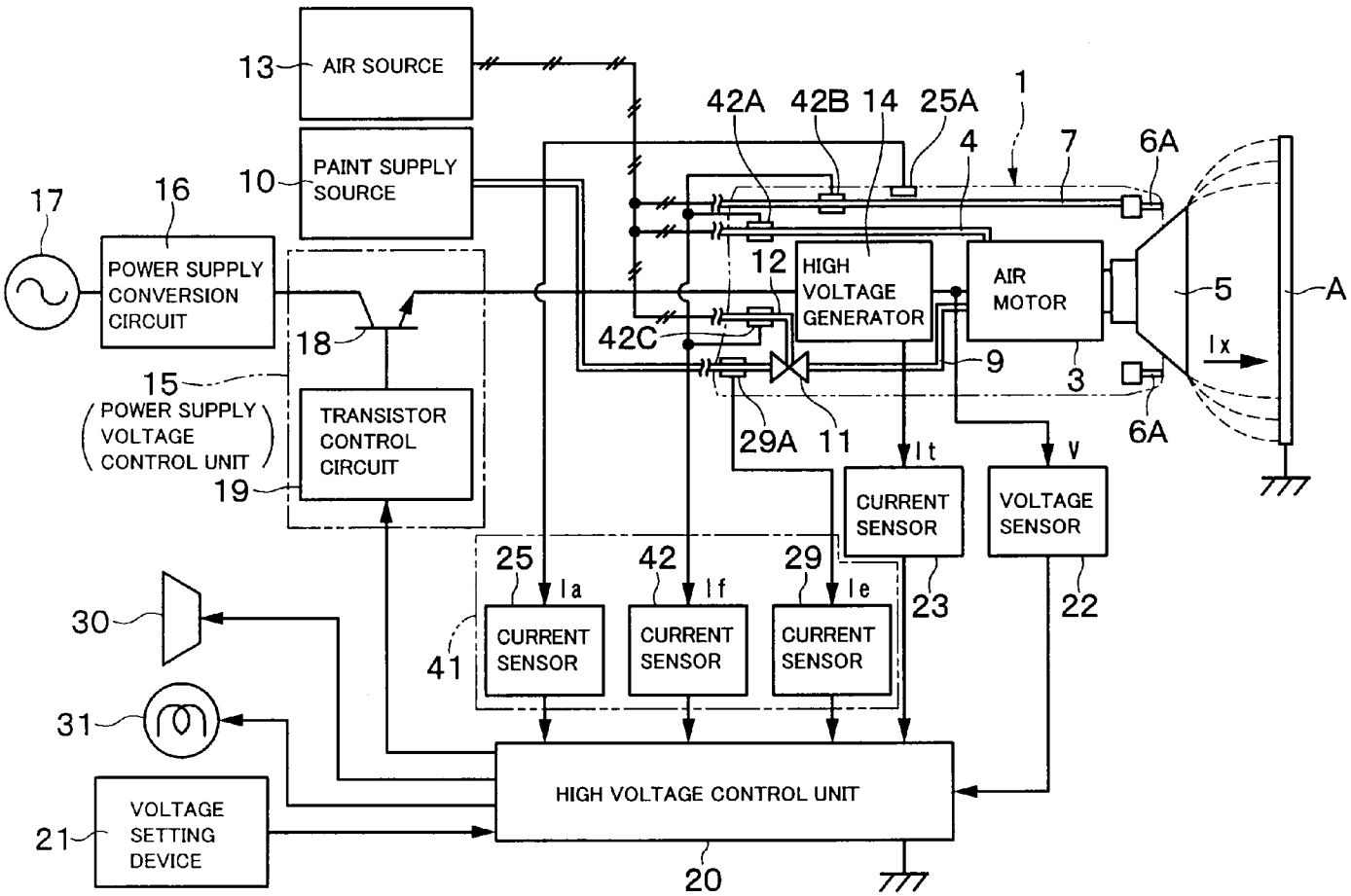
FIG. 9 is a diagram showing the general configuration of a rotary atomizing head type coating apparatus according to a third embodiment.

Turning now to FIG. 9, there is shown a rotary atomizing head type coating apparatus according to a third embodiment. The feature of this embodiment resides in that an all air passage current detector is provided for detecting a current that flows through a drive air passage, a current that flows through a shaping air passage and a current that flows through a supply valve drive air passage, simultaneously. In the following of the third embodiment, those component parts which are identical with the counter parts in the foregoing first embodiment are simply designated by the same reference numerals or characters to avoid repetitions of same explanations.

Indicated at 41 is a leakage current detector served as leakage current detection means for the third embodiment. The leakage current detector 41 detects a leakage current that flows without passing through an object A and outputs the detection value to a high voltage control unit 20. Further, the leakage current detector 41 includes a current sensor 25 served as an external surface current detector and a current sensor 29 served as a paint passage current detector as well as the leakage current detector 24 in the first embodiment. However, this embodiment differs from the first embodiment in that a single current sensor 42 is provided instead of the current sensors 26 to 28 in the first embodiment.

Indicated at 42 is a current sensor served as an all air passage current detector. The current sensor 42 is provided instead of the current sensors 26 to 28 in the first embodiment and connected to a conductive terminal 42A on the way of a drive air passage 4, a conductive terminal 42B on the way of a shaping air passage 7 and a conductive terminal 42C on the way of a supply valve drive air passage 12. Moreover, through the conductive terminals 42A to 42C, the current sensor 42 detects currents that flow through the individual air passages 4, 7 and 12, and outputs a current detection value If (If=Ib+Ic+Id) which is the total of these currents to the high voltage control unit 20.

Thus, substantially in the same manner as in the first embodiment, the high voltage control unit 20 employs current detection values It, Ia, If and Ie to calculate an object current value Ix and employs the current detection value If to cut off the supply of a voltage or to generate an alarm.

Therefore, in the third embodiment, the same operational effects as in the foregoing first embodiment can be obtained. However, in this embodiment, since the leakage current detector 41 includes the current sensor 42 which simultaneously detects the current that flows through the drive air passage 4, the current that flows through the shaping air passage 7 and the current that flows through the supply valve drive air passage 12, a single current sensor 42 is employed to simultaneously detect the leakage current that flows through all the air passages 4, 7 and 12.

As a result, since the high voltage control unit 20 can recognize the progress of the dielectric breakdown in the air passages 4, 7 and 12, the attachment or accumulation of dust, water, etc., on the inner wall of the air passage 4, 7 or 12 can be detected. Therefore, before a dielectric breakdown occurs in the inner wall of the air passage 4, 7 or 12, the high voltage control unit 20 can cut off the supply of a high voltage, so that damage to the air passage 4, 7 or 12 can be prevented and the reliability and durability can be increased. Furthermore, before damage to the inner wall of the air passage 4, 7 or 12 due to the creepage discharge is developed the high voltage control unit 20 can generate an alarm to request the cleaning of the air passage 4, 7 or 12 or the cleaning of a filter or a dryer of the air source 13.

In addition, the drive air passage 4, the shaping air passage 7 and the supply valve drive air passage 12 are connected to the common air source 13 and the same air is supplied to all. Therefore, the factor for the reduction of the insulation in the all individual air passages 4, 7 and 12 is the attachment of water or dust (a fine mist) in the air to the inner walls of the air passages 4, 7 and 12. Thus, the insulation in these air passages 4, 7 and 12 tends to be reduced at the same time. On the other hand, since the current sensor 42 detects simultaneously (totalizes) the leakage current that flows through all the air passages 4, 7 and 12. When the insulation is reduced, at the any air passages 4, 7 or 12, it can be detected quickly and accurately.

Furthermore, since only one current sensor 42 is employed for a plural number of air passages 4, 7 and 12, compared with the first embodiment wherein current sensors are respectively provided for a plural number of air passages 4, 7 and 12, the number of current sensors can be reduced. Thus, the control functions for the voltage cutoff process and the alarm process can be simplified and the manufacturing cost for the entire apparatus can be reduced.

It should be noted that the first and the second embodiment, steps 5 to 14 and 26 to 37 are specific examples for power supply cutoff means, steps 15 to 18 and 38 to 41 are specific examples for notification means, steps 4 and 24 are specific examples for object current calculation means, steps 5 to 8 and 28 to 31 are specific examples for object current abnormality process means, and steps 25 to 29 are specific examples for slope abnormality process means.

Further, the cutoff threshold current values It0, Ix0 and Ia0 to Ie0, the cutoff threshold change value ΔIx0, the alarm threshold current values Ia1 to Ie1, etc., are not limited to the values exemplified in FIG. 3 and in the individual embodiments, and are appropriately designated in accordance with the type of coating machine, the coating conditions, and so forth.

Furthermore, in the second embodiment, the object current change value ΔIx has been employed for the cutoff process for cutting off the supply of a voltage. However, the present invention is not limited to this arrangement. For example, a change value of the object current may be employed for an alarm process to permit the alarm means to generate an alarm.

In addition, according to foregoing embodiments, an explanation has been given by employing a rotary atomizing head type coating apparatus of a direct charging type to charge a paint directly at a high voltage through the rotary atomizing head 5 which is made of a metallic material or a conductive resin material. However, the present invention is not limited to the direct charging type. The present invention may be applied for a rotary atomizing head type coating apparatus of an indirect charging type having external electrode on the outer surface of the cover of a rotary atomizing head type coating apparatus, and by using the external electrode, paint sprayed from a rotary atomizing head is indirectly charged using a high voltage.

Moreover, in the foregoing embodiments, the present invention has been described by way of example to apply to a rotary atomizing head type coating apparatus (a rotary atomizing electrostatic coating apparatus) by using the rotary atomizing head 5 to spray paint as an electrostatic coating apparatus. However, the present invention is not limited to this arrangement, and may be applied for an electrostatic coating apparatus such as a pneumatic atomizing type electrostatic coating apparatus or a hydraulic atomizing type electrostatic coating apparatus employing an atomizing system other than a rotary atomizing system. In this case, conductive terminals are provided on the surface of the insulating cover of a coating machine, a paint passage, a supply valve drive air passage and various other passages for atomizing air, shaping air (pattern formation air), and so forth, and a current sensor is connected to the conductive terminals. Then, the current sensor is employed to detect currents that flow through the individual passages.

The invention claimed is:

1. An electrostatic coating apparatus, comprising:

a coating machine for spraying paint to a coating object, said coating machine including an air motor rotationally driven by drive air, a rotational shaft rotated by said air motor, a rotary atomizing head provided at a distal end of said rotational shaft for spraying paint supplied through a paint supply valve while being rotated by said rotational shaft, and a shaping air ring provided on an outer side of said rotary atomizing head and having air outlet holes for spouting shaping air to form a paint spray pattern;

a high voltage generator for boosting a power supply voltage to generate a high voltage and for outputting said high voltage to said coating machine;

a power supply voltage control unit for controlling a power supply voltage to be supplied to said high voltage generator;

a high voltage control unit for outputting a setting signal to set a power supply voltage for said power supply voltage control unit and for controlling a high voltage to be output by said high voltage generator;

full return current detection means for detecting a full return current that flows through said high voltage generator and for outputting the detected full return current as a full return current detection value;

leakage current detection means for detecting a flow of a leakage current that does not pass through said coating object and for outputting the detected leakage current as a leakage current detection value, said leakage current detection means including an all air passage current detector for detecting simultaneously a current that flows along a drive air passage for supplying said drive air, a current that flows along a shaping air passage for supplying said shaping air, and a current that flows along a supply valve drive air passage to drive open and close said paint supply valve, and said leakage current detection value including said detected current that flows along the drive air passage, said detected current that flows along the shaping air passage, and said detected current that flows along the supply valve drive air passage;

power supply cutoff means, associated with said high voltage control unit, for outputting a cutoff signal to said power supply voltage control unit to cut off the supply of said power supply voltage after deterioration of insulation for said coating machine is determined by employing the full return current detection value output by said full return current detection means and the leakage current detection value output by said leakage current detection means;

alarm means for outputting an alarm that said reduction of insulation has occurred in said coating machine after reduction of insulation at an initial stage is determined by employing the leakage current detection value output by said leakage current detection means; and object current calculation means, associated with said power supply cutoff means, for subtracting the leakage current detection value output by said leakage current detection means from the full return current detection value output by said full return current detection means and calculating an object current that flows between said coating machine and said coating object.

2. An electrostatic coating apparatus as defined in claim 1, wherein said leakage current detection means includes an external surface current detector for detecting a current that flows along the external surface of said coating machine.

3. An electrostatic coating apparatus as defined in claim 1, wherein said leakage current detection means includes a paint passage current detector for detecting a current that flows along a paint passage within said coating machine.

4. An electrostatic coating apparatus as defined in claim 1, wherein said leakage current detection means includes an external surface current detector for detecting a current that flows along an external surface of said coating machine, and a paint passage current detector for detecting a current that flows along a paint passage within said coating machine.

5. An electrostatic coating apparatus as defined in claim 1, wherein said power supply cutoff means includes object current abnormality processing means for outputting a cutoff signal to said power supply voltage control unit to cut off the supply of said power supply voltage when said object current obtained by said object current calculation means exceeds a predetermined cutoff threshold current value.

6. An electrostatic coating apparatus as defined in claim 1, wherein said power supply cutoff means includes a slope abnormality processing means for outputting a cutoff signal to said power supply voltage control unit to cut off the supply of said power supply voltage when a change value of said object current obtained by said object current calculation means exceeds a predetermined cutoff threshold change value.

7. An electrostatic coating apparatus, comprising:

a coating machine for spraying paint to a coating object, said coating machine including an air motor rotationally driven by drive air, a rotational shaft rotated by said air motor, a rotary atomizing head provided at a distal end of said rotational shaft for spraying paint supplied through a paint supply valve while being rotated by said rotational shaft, and a shaping air ring provided on an outer side of said rotary atomizing head and having air outlet holes for spouting shaping air to form a paint spray pattern;

a high voltage generator for boosting a power supply voltage to generate a high voltage and for outputting said high voltage to said coating machine;

a power supply voltage control unit which controls a power supply voltage to be supplied to said high voltage generator;

a high voltage control unit which outputs a setting signal to set a power supply voltage for said power supply voltage control unit and which controls a high voltage to be output by said high voltage generator;

a full return current sensor which detects a full return current that flows through said high voltage generator and outputs the detected full return current as a full return current detection value;

a leakage current sensor which detects a flow of a leakage current that does not pass through said coating object and outputs the detected leakage current as a leakage current detection value, said leakage current sensor including an all air passage current detector for detecting simultaneously a current that flows along a drive air passage for supplying said drive air, a current that flows along a shaping air passage for supplying said shaping air, and a current that flows along a supply valve drive air passage to drive open and close said paint supply valve, and said leakage current detection value including said detected current that flows along the drive air passage, said detected current that flows along the shaping air passage, and said detected current that flows along the supply valve drive air passage;

a power supply cutoff unit, associated with said high voltage control unit, which outputs a cutoff signal to said power supply voltage control unit to cut off the supply of said power supply voltage after deterioration of insulation for said coating machine is determined by employing the full return current detection value output by said full return current sensor and the leakage current detection value output by said leakage current sensor;

an alarm unit which outputs an alarm that said reduction of insulation has occurred in said coating machine after reduction of insulation at an initial stage is determined by employing the leakage current detection value output by said leakage current sensor; and an object current calculation unit, associated with said power supply cutoff unit, which subtracts the leakage current detection value output by said leakage current sensor from the full return current detection value output by said full return current sensor and calculates an object current that flows between said coating machine and said coating object.

8. An electrostatic coating apparatus as defined in claim 7, wherein said leakage current sensor includes an external surface current detector for detecting a current that flows along the external surface of said coating machine.

9. An electrostatic coating apparatus as defined in claim 7, wherein said leakage current sensor includes a paint passage current detector for detecting a current that flows along a paint passage within said coating machine.

10. An electrostatic coating apparatus as defined in claim 7, wherein said leakage current sensor includes an external surface current detector for detecting a current that flows along an external surface of said coating machine, and a paint passage current detector for detecting a current that flows along a paint passage within said coating machine.

11. An electrostatic coating apparatus as defined in claim 7, wherein said power supply cutoff unit includes an object current abnormality processing unit for outputting a cutoff signal to said power supply voltage control unit to cut off the supply of said power supply voltage when said object current obtained by said object current calculation unit exceeds a predetermined cutoff threshold current value.

12. An electrostatic coating apparatus as defined in claim 7, wherein said power supply cutoff unit includes a slope abnormality processing unit for outputting a cutoff signal to said power supply voltage control unit to cut off the supply of said power supply voltage when a change value of said object current obtained by said object current calculation unit exceeds a predetermined cutoff threshold change value.

* * * * *